US005267874A

United States Patent [19]

Koegel et al.

[11] Patent Number: 5,267,874

[45] Date of Patent: Dec. 7, 1993

[54] CONNECTOR WITH WIRE GUIDING FIXTURE

[75] Inventors: Keith S. Koegel, Linglestown; Reuben E. Ney, Mount Joy; William E. Zelko, Dauphin; Charles A. Miller, York New Salem; Mark A. Wojcicki; Gary D. Balon, both of Hershey, all of Pa.

[73] Assignee: The Whitaker Corporation, Wilmington, Del.

[21] Appl. No.: 56,520

[22] Filed: Apr. 28, 1993

[51] Int. Cl.[5] ..... H01R 11/00

[52] U.S. Cl. ..... 439/497; 439/607

[58] Field of Search ..... 439/492–499, 439/607–610

[56] References Cited

U.S. PATENT DOCUMENTS

| | | | |
|---|---|---|---|
| 3,958,852 | 5/1976 | Abraham et al. | 339/91 P |
| 4,083,615 | 4/1978 | Volinskie | 339/17 F |
| 4,310,208 | 1/1982 | Webster et al. | 339/14 R |
| 4,579,404 | 4/1986 | Lockard | 339/14 R |
| 4,602,830 | 7/1986 | Lockard | 339/14 R |
| 4,602,831 | 7/1986 | Lockard | 339/14 R |
| 4,655,515 | 4/1987 | Hamsher, Jr. et al. | 339/14 R |
| 4,767,357 | 8/1988 | Hasircoglu | 439/499 |
| 4,875,877 | 10/1989 | Fleak et al. | 439/497 |
| 4,973,264 | 11/1990 | Kamono et al. | 439/498 |
| 4,993,968 | 2/1991 | Guletsky et al. | 439/492 |
| 5,030,138 | 7/1991 | Capp et al. | 439/497 |
| 5,085,595 | 2/1992 | Koegel et al. | 439/494 |

*Primary Examiner*—Joseph H. McGlynn

[57] ABSTRACT

A wire organizer (16) comprises, signal wire receiving passages (22), fingers (19) receiving electrical contacts (9) of an electrical connector assembly (6), and each of the passages (22) that receives a signal wire (2) superposes the signal wire (2) over one of the contacts (9) for joined connection of the signal wire (2) to the contact (9).

11 Claims, 2 Drawing Sheets

CONNECTOR WITH WIRE GUIDING FIXTURE

FIELD OF THE INVENTION

The invention relates to a wire organizer for positioning wires of electrical cable, and more particularly, for positioning wires of an electrical cable on pitch spacings of electrical contacts of an electrical connector assembly.

BACKGROUND OF THE INVENTION

A connector assembly disclosed in U.S. Pat. No. 4,875,877, comprises, conductive signal contacts for connection to signal wires of at least one electrical cable, wherein, an insulating housing block is applied over the contacts, by injection molding, for example. Windows in the housing block expose the contacts for connection of the contacts with respective wires of at least one electrical cable. The insulative housing block is a permanent fixture on the contacts, and is obtained by an injection molding operation that subjects the contacts to an added manufacturing process that adds further complexity to the manufacture of the contacts.

SUMMARY OF THE INVENTION

The invention was developed with an aim to eliminate an added manufacturing process that would add further complexity to the manufacture of the contacts of an electrical connector assembly.

According to a feature of the invention, a wire organizer is manufactured as a separate component part with wire alignment passages constructed for receiving signal wires of one or more electrical cables.

A further feature of the invention resides in a wire organizer that is a separate component part having wire alignment passages and a base that mounts onto electrical contacts projecting from an electrical connector assembly. The passages align one or more signal wires of at least one electrical cable with respective electrical contacts while the wires are joined with the contacts.

An advantage of the invention resides in a wire organizer that aligns signal wires and electrical contacts of a connector assembly, without a manufacturing operation adding complexity to the manufacture of the contacts.

Another advantage of the invention resides in a wire organizer that can be mounted, first, onto electrical wires of at least one electrical cable, and second, onto electrical contacts of an electrical connector assembly, to align the wires for joined connection with the contacts.

According to the invention, a wire organizer for an electrical connector comprises, an insulative base, wire receiving passages crossing the base, respective wire align ground wires and signal wires across the base, and fingers projecting from the base, wherein the fingers align the base with electrical contacts projecting from an electrical connector assembly.

An embodiment of the invention will be described by way of example with reference to the accompanying drawings, according to which:

DETAILED DESCRIPTION

Figure 1:
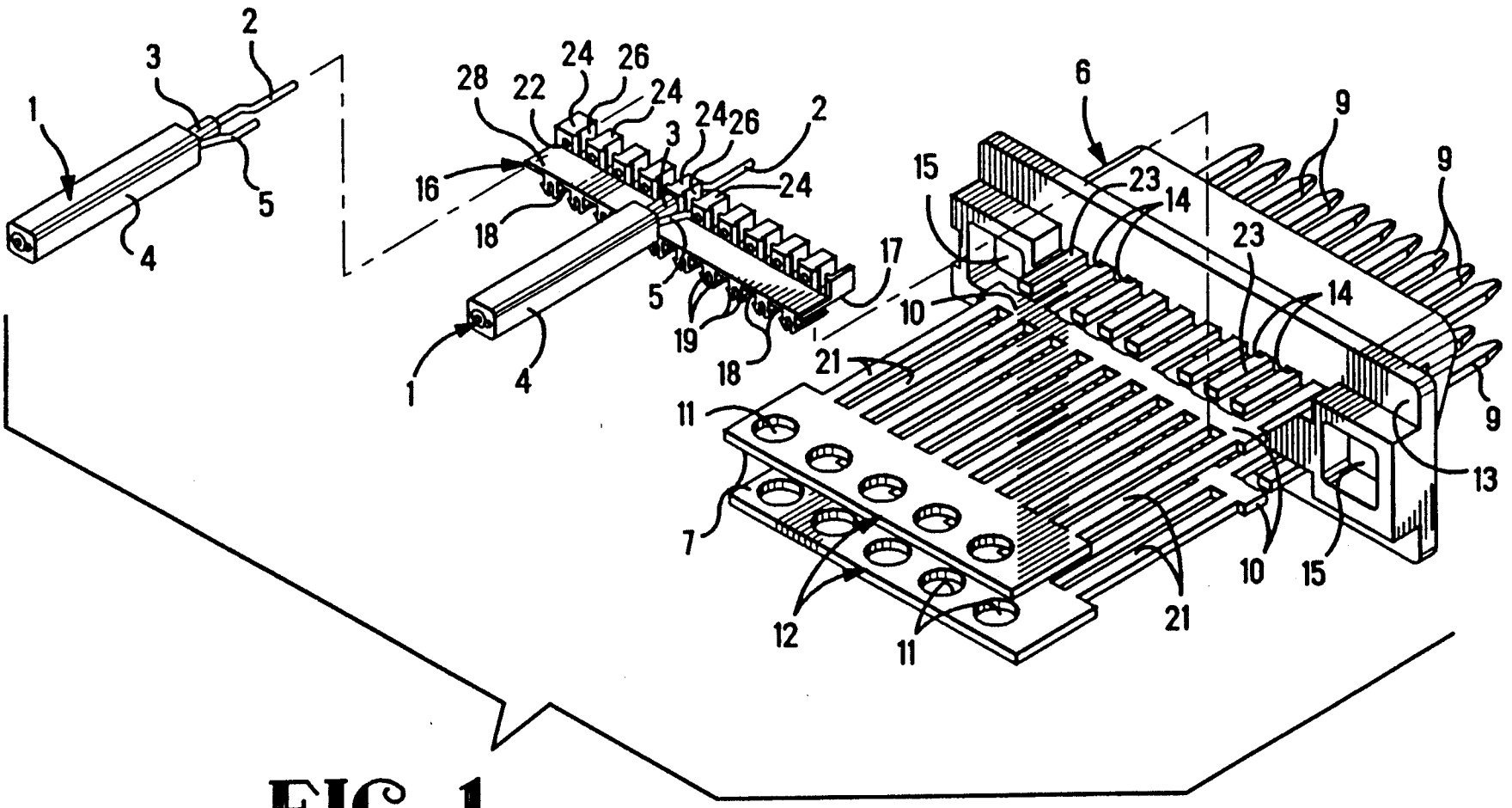
FIG. 1 is a perspective view of a wire organizer and a connector assembly adapted with the wire organizer, with parts separated from one another.
Figure 2:
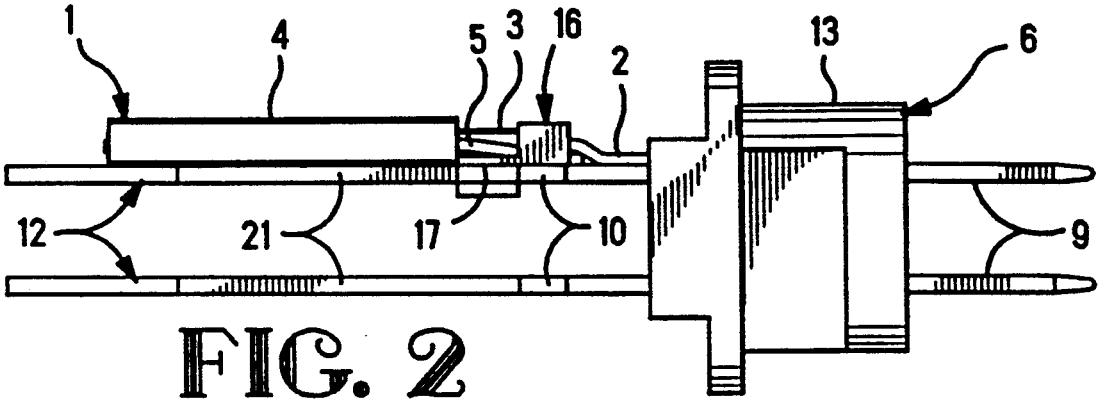
FIG. 2 is a side elevation view illustrating the parts shown in FIG. 1 assembled together.
Figure 3:
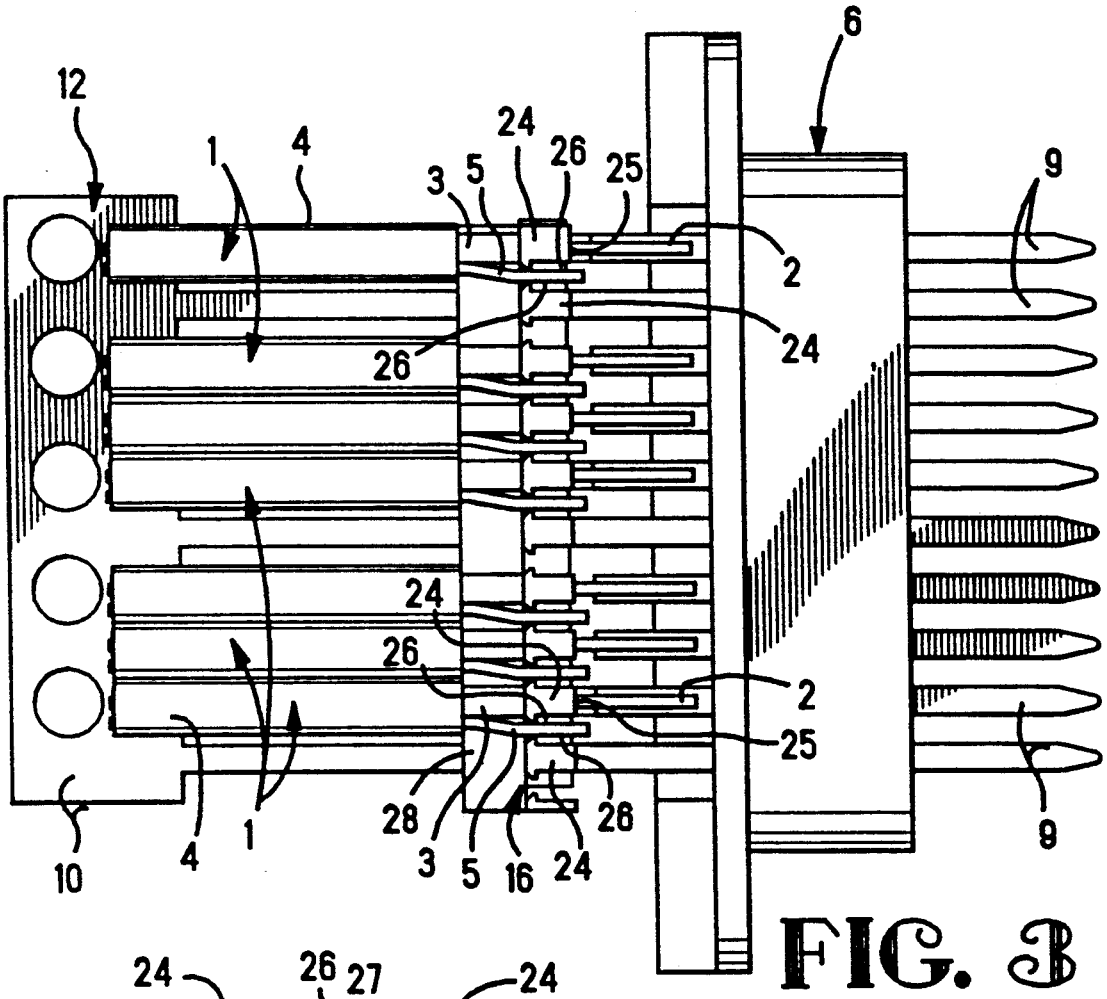
FIG. 3 is a top plan view of the parts shown in FIG. 2.

With reference to FIGS. 1-3, at least one electrical cable 1 comprises an elongated signal wire 2 or center conductor concentrically encircled by a dielectric 3, in turn, encircled by a flexible insulative outer jacket 4 or sheath. A corresponding, elongated and conductive ground wire 5 or drain wire extends along the exterior of the dielectric 3 and is within the jacket 4. The cable may include a single ground wire 5, as shown, or may include first and second ground wires 5 to provide a combination of a signal wire 2 between two ground wires 5.

With reference to FIGS. 1-3, an electrical connector assembly 6 is to be connected to at least one electrical cable 1 or to multiple electrical cables 1. The connector assembly 6 is constructed with at least one row of conductive electrical contacts 9 projecting forwardly from an elongated ground bus 10. A series of pilot holes 11 extend through a carrier strip 7. A lead frame 12 joins the contacts 9 and the ground bus 10 and the carrier strip 7. The contacts 9 are on pitch spacings, that are the repeated spacings between longitudinal axes of the multiple contacts 9 in a row. The connector assembly 6 further comprises an insulative housing 13 having cavities 14 on the pitch spacings of the contacts 9. The contacts 9 extend along the cavities 14 and project rearwardly of the housing 13. Rearward facing latch elements in the form of recesses 15 of rectangular shape in the housing 13 are at opposite ends of the row of contacts 9.

The connector assembly 6 further comprises a second lead frame 12 comprising, a second row of contacts 9 spaced from the first row of contacts 9, and a second ground bus 10 and a second carrier strip 7 with pilot holes 11 aligned with the pilot holes 11 of the first carrier strip 7.

The ground bus 10 of each lead frame 12 is joined to the carrier strip 7 by slender links 21 of the contacts 9 extending rearwardly of the housing 13 to the carrier strips 7. When two rows of contacts 9 are present, the slender links 21 are easily bent toward each other to bring the carrier strips 7 together, not shown. Alternatively, the slender links 21 of the lead frames 12 can be unbent to maintain the carrier strips 7 separated from each other, as shown in FIG. 1.

The contacts 9 are constructed to be separated from the ground bus 10. In FIG. 1, selected ones of the contacts 9 have been separated from the ground bus 10, for example, by drilling or punching the contacts 9 to sever them from the ground bus 10, leaving free ends 23 of the contacts 9. At least one electrical contact 9 of the row remains joined to the ground bus 10.

The ground bus 10 provides a continuous surface for direct connection of a ground wire 5 of at least one electrical cable 1. The surfaces of the ground bus 10 and of the contacts 9 are adapted to be joined by direct connection to corresponding ground wires 5 and signal wires 2 by welding, and alternatively, by solder joining. Each of the contacts 9 remaining joined to the ground bus 10, and each of the free ends 23 of selected ones of the contacts 9, are to be connected to respective signal wires 2 of at least one electrical cable 1.

Figure 4:
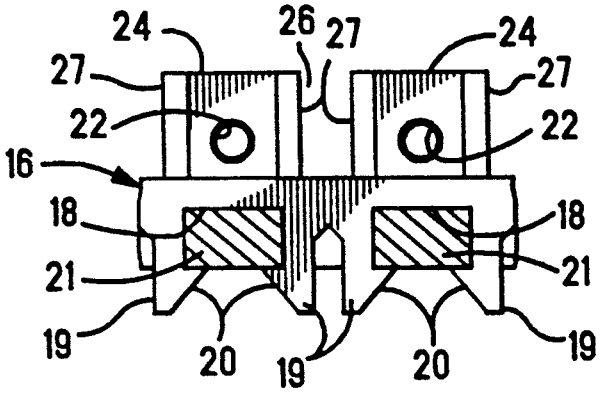
FIG. 4 is an enlarged fragmentary section view of a portion of the wire organizer shown in FIG. 1.

An insulative wire organizer 16 for the electrical connector assembly 6, is of unitary molded construction, and comprises, an insulative base 17, under which multiple contact receiving passages 18 cross the base 17. The contact receiving passages are between multiple, spaced apart fingers 19, FIG. 4, that project from and depend from the base 17. A hook shaped latch 20 at a tapered tip of each of the fingers 19 faces toward, and overhangs one of the passages 18. The fingers 19 align the base 17 with the links 21 of the electrical contacts 2. The fingers 19 are resiliently deflectable to move the links 21 past the latches 20 and into the passages 18. The latches 20 secure the wire organizer 16 on the links 21 of the contacts 9. Adjacent contacts 9 are separated from one another by the fingers 19.

Signal wire receiving passages 22 extend across a top of the base 17, concentrically through insulative sleeves 24 on the wire organizer 16. The signal wire receiving passages 22 are in superposed alignment with the contact receiving passages 18. The signal wire receiving passages 23 and the contact receiving passages 18 are spaced apart on pitch spacings that equal the pitch spacings of the contacts 9.

Each of the signal wire receiving passages 22 is constructed to receive a signal wire 2 of at least one electrical cable 1 across the base 17. Each insulative sleeve 23 that receives a signal wire 2 surrounds the signal wire 2 concentrically, comprising a coaxial construction. Forward open ends 25 of the signal wire receiving passages 22 are in superposed alignment with the contact receiving passages 18. The signal wire 2 projects beyond an open end of the passage 22. Each of the signal wire receiving passages 22 that receives a signal wire 2 superposes the signal wire 2 over one of the contacts 9 for joined connection of the signal wire 2 to the contact 9, FIG. 3. For example, the signal wire 2 is joined to the contact 9 by a welding operation or by a soldering operation.

Ground wire receiving passages 26 of the wire organizer 16 cross the base 17 between adjacent insulative sleeves 23. The ground wire receiving passages 26 are aligned with the ground bus 10 projecting rearwardly of the housing 13 of the electrical connector assembly 6. Each of the ground wire receiving passages 26 are constructed to receive a ground wire 5. Each of the ground wire receiving passages 26 that receives a ground wire 5 of at least one electrical cable 1 superposes the ground wire 5 with the ground bus 10 for joined connection.

Each ground wire receiving passage 26 is of a channel shape that is different from the shape of the insulative sleeves 24. The ground wire receiving passages 26 are shape-coded to distinguish them from the signal wire receiving passages 22, to avoid a mistake of assembling a signal wire 2 along a ground wire receiving passage 26. Each of the adjacent insulating sleeves 24 comprises a projecting rib 27 that juts into a ground wire receiving passage 26. The rib 27 is constructed to grip a ground wire 5 with an interference fit to secure the cable 1, and to attach the wire organizer 16 to the cable 1.

The wire organizer 16 can be attached to one cable 1, as in FIG. 1, or multiple cables 1, as in FIG. 3. The wire organizer 16 can be attached to one or more cables 1, prior to being mounted on the contacts 9. Alternatively, the wire organizer 16 can be mounted on the contacts 9 prior to being attached to one or more cables 1. A shelf 28 on the base 17 in front of the insulative sleeves 24 supports each cable 1. More particularly, the dielectric 3 and each ground wire 5 of each cable 1 is supported on the shelf 28. The wire organizer 16 is a separate part, and is assembled to the contacts 9, after the contacts 9 have been assembled with the connector assembly 6. Accordingly, the wire organizer 16 aligns each signal wire 2 with one of the contacts 9 without a requirement for modification of the contacts 9. Each ground wire 5 is aligned with the ground bus 10 without a requirement for modification of the contacts 9.

We claim:

1. A wire organizer for an electrical connector assembly, comprising: an insulative base, signal wire receiving passages crossing the base, and fingers projecting from the base, wherein; forward open ends of the wire receiving passages are in superposed alignment with contact receiving passages, each of the signal wire receiving passages is constructed to receive a signal wire of at least one electrical cable, the fingers align the base with electrical contacts of an electrical connector assembly, and each of the wire receiving passages that receives a signal wire superposes the signal wire over one of the contacts for joined connection of the signal wire to the contact.

2. A wire organizer as recited in claim 1, wherein: the wire receiving passages extend through insulative sleeves, each insulative sleeve that receives a signal wire surrounds the signal wire concentrically.

3. A wire organizer as recited in claim 1, wherein: ground wire receiving passages cross the base, and each of the ground wire receiving passages that receives a ground wire comprises an interference fit with a ground wire of at least one electrical cable.

4. A wire organizer as recited in claim 1, wherein: the fingers depend from the base, and the wire receiving passages extend across a top of the base.

5. A wire organizer as recited in claim 1, wherein: the fingers are on a pitch spacing corresponding to a pitch spacing of electrical contacts projecting rearward of an insulating housing of an electrical connector.

6. A wire organizer as recited in claim 1, wherein: the signal wire receiving passages extend through insulative sleeves, each insulative sleeve that receives a signal wire surrounds the signal wire concentrically, ground wire receiving passages cross the base, the ground wire receiving passages are shape-coded to distinguish them from the signal wire receiving passages, the ground wire passages are aligned with a ground bus projecting rearwardly of a housing of an electrical connector, and each of the ground wire passages that receives a ground wire of at least one electrical cable superposes the ground wire and the ground bus.

7. A wire organizer as recited in claim 1, wherein: ground wire receiving passages cross the base, the ground wire receiving passages are shape-coded to distinguish them from the signal wire receiving passages, the ground wire passages are aligned with a ground bus projecting rearwardly of a housing of an electrical connector, and each of the ground wire passages that receives a ground wire of at least one electrical cable superposes the ground wire and the ground bus.

8. A wire organizer as recited in claim 1, wherein: latches on the fingers face the contact receiving passages for latching to the electrical contacts.

9. A method for joining wires to electrical contacts of an electrical connector comprising the steps of;

projecting multiple, signal wires along wire receiving passages extending across an insulative base, projecting the wires forwardly of the passages for alignment with respective electrical contacts of an electrical connector, aligning the base with the contacts to align the wires with the contacts, and joining the wires to the contacts while the base is aligned with the contacts.

10. A method as recited in claim 8, comprising the step of: latching the base to the contacts prior to the step of joining the wires to the contacts while the base is aligned with the contacts.

11. A method as recited in claim 8, comprising the steps of: projecting multiple ground wires along respective wire receiving passages extending across the base, aligning the ground wires with a ground bus of an electrical connector, and joining the ground wires to the ground bus while the base is aligned with the contacts.

* * * * *